US008978832B2

(12) United States Patent
Studer

(10) Patent No.: US 8,978,832 B2
(45) Date of Patent: Mar. 17, 2015

(54) HOLDING BRAKE WITH LOCKING MECHANISM

(75) Inventor: Christian Studer, Lucerne (CH)

(73) Assignee: Inventio AG, Hergiswil (CH)

( * ) Notice: Subject to any disclaimer, the term of this patent is extended or adjusted under 35 U.S.C. 154(b) by 540 days.

(21) Appl. No.: 13/160,859

(22) Filed: Jun. 15, 2011

(65) Prior Publication Data

US 2011/0303494 A1 Dec. 15, 2011

(30) Foreign Application Priority Data

Jun. 15, 2010 (EP) ..... 10166041

(51) Int. Cl.
*B66B 1/36* (2006.01)
*B66B 5/18* (2006.01)

(52) U.S. Cl.
CPC ..... *B66B 5/18* (2013.01)
USPC ..... 187/359

(58) Field of Classification Search
CPC ..... B66B 5/12; B66B 5/16
USPC ..... 187/359, 366, 370, 375
See application file for complete search history.

(56) References Cited

U.S. PATENT DOCUMENTS

| | | | | |
|---|---|---|---|---|
| 4,375,250 | A * | 3/1983 | Burgdorf | 188/72.2 |
| 5,363,942 | A * | 11/1994 | Osada | 187/376 |
| 5,791,442 | A | 8/1998 | Arnold | |
| 6,425,462 | B1 * | 7/2002 | Tran et al. | 187/367 |
| 2011/0226560 | A1 * | 9/2011 | Husmann | 187/359 |

FOREIGN PATENT DOCUMENTS

| | | | |
|---|---|---|---|
| EP | 0648703 | A1 | 4/1995 |
| EP | 0999168 | A2 | 5/2000 |
| EP | 1840068 | A1 | 10/2007 |
| WO | 2008057116 | A1 | 5/2008 |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A holding brake is designed for use in an elevator installation, the installation comprising an elevator cage, a drive and a drive control, wherein a support is movable by way of the drive and the elevator cage is movable by way of this support. The holding brake is designed for application of a mechanical braking action relative to a guide rail of the elevator installation so that the elevator cage after actuation of the holding brake retains its vertical position. The holding brake comprises a locking mechanism which is designed so that it acts from two opposite sides on the guide rail.

11 Claims, 3 Drawing Sheets

11 DRIVE
12 ELEVATOR CAGE
13 BRAKING SYSTEM
14 ELEVATOR SHAFT
15 DRIVE CONTROL
17 GUIDE RAIL
19 COUNTERWEIGHT
20 HOLDING BRAKE

HOLDING BRAKE WITH LOCKING MECHANISM

CROSS-REFERENCE TO RELATED APPLICATION

This application claims priority to European Patent Application No. 10166041.3, filed Jun. 15, 2010, which is incorporated herein by reference.

FIELD

The disclosure relates to a holding brake for an elevator installation.

BACKGROUND

Elevator systems of a conventional kind generally comprise a drive, a drive control associated with the drive and a braking system.

Holding brakes, which usually must fulfill prescriptions with regard to safety regulations, are employed at the elevator cages.

A hydraulically actuable disc brake is known from patent specification EP 0 648 703 B1, in which, in the case of braking, brake plates engage a guide rail and the elevator cage is secured at a story stop against impermissible upward movements and downward movements.

A locking device which is engageable from outside and which in company with the movement in upward direction or downward direction of the elevator cage builds up the necessary braking force in order to stop the elevator cage is known from patent application EP 0 999 168 A2/A3.

An elevator installation with a cage brake has become known from EP 1 840 068 A1, in which brake wedges slide on tracks extending obliquely with respect to a guide rail. In the case of braking a respective hydraulic actuator pushes a respective brake wedge along the track against the travel direction of the elevator cage. As soon as the brake wedge comes into contact with the guide rail the brake wedge moves further on the track and wedges between the guide rail and the track in brake-amplifying manner.

SUMMARY

At least some embodiments of the disclosed technologies comprise a holding brake which combines a simple construction with a safe function. In particular embodiments, the holding brake can exert a direct braking action.

At least some embodiments are equipped with a locking mechanism, possibly a double-acting locking mechanism, for holding a elevator cage in a fixed shaft position.

The holding brake can exert a form of symmetrical clasping action. The clasping action can arise due to unilaterally acting traction elements of the locking mechanism.

In one embodiment the holding brake comprises a double-acting brake which acts symmetrically. In that case, two opposite brake shoes act as active brake shoes and produce a braking force at a guide rail.

Use can be made of a holding brake which is designed specifically for use in an elevator installation comprising an elevator cage. The holding brake is designed for application of a mechanical braking action relative to a guide rail of the elevator installation so that the elevator cage or the counterweight, after actuation of the holding brake, keeps its vertical position. For this purpose the holding brake can comprise a locking mechanism, possibly a double-acting locking mechanism, which is so designed that it acts on the guide rail from two mutually opposite sides and amplifies the braking force.

In some embodiments, a minimum vertical movement of the elevator cage or of the counterweight is sufficient in order to trigger an amplified or self-amplifying locking function of the holding brake. This locking function can be triggered by use of the locking mechanism not only if the elevator cage or the counterweight should move a small amount upwardly (here termed impermissible movement), but also if the elevator cage or the counterweight should move a small amount downwardly (here termed impermissible movement).

In further embodiments, the holding brake has a self-locking function, since sometimes even in the case of a small undesired movement of the elevator cage the braking action increases quasi-automatically.

In additional embodiments, the locking mechanism is equipped with at least one actuator in order to be able to so adjust, in an initial movement or adjusting movement, brake bodies that in the activation case they only have to execute a small closing movement (engagement movement) in order to more firmly fix the elevator cage.

BRIEF DESCRIPTION OF THE DRAWINGS

The disclosed technologies are described in detail in the following on the basis of exemplifying embodiments and with reference to the figures.

DETAILED DESCRIPTION

Figure 1:
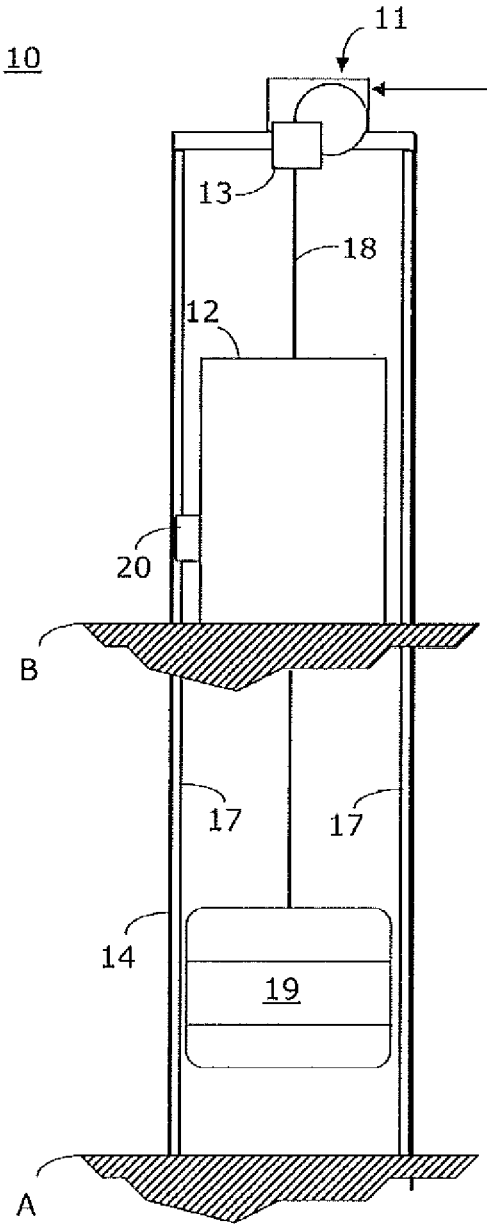
FIG. 1 shows a elevator installation with a first holding brake, in substantially simplified schematic illustration.

FIG. 1 shows a first exemplary embodiment in a schematic overall illustration. An elevator installation 10 is shown in strongly schematic form. The elevator installation 10 comprises an elevator cage 12 and a corresponding counterweight 19, which are guided to be vertically movable in opposite sense in a elevator shaft. The elevator cage 12 can serve several stories (here two stories A and B are shown). The elevator cage 12 can be moved by a drive 11 which, by way of example as indicated in FIG. 1, is disposed at the upper shaft end. Apart from the drive 11, the elevator installation 10 comprises a drive control 15, which is associated with the drive 11, and a braking system 13. The elevator cage 12 is here connected with the counterweight 19 by way of a support means 18 which runs around a drive pulley of the drive 11. The linking, in terms of control, of the drive control 15 with the elements of the elevator installation 10 is schematically indicated by a double arrow 16, which symbolizes a connection between the drive 11 and the drive control 15. The drive control 15 typically receives signals by way of, for example, the control link 16. These signals are converted into control magnitudes. If the drive 11 sets the elevator cage 12 in motion, at least one holding brake 20, which is arranged at the elevator cage 12 and mechanically interacts with at least one guide rail 17 in the elevator shaft 14, is released.

On reaching a destination story (for example story B in FIG. 1) the speed of the drive 11 is slowed down and the braking system 13 is activated. When the correct vertical position in the elevator shaft 14 has been reached, the holding brake 20 comes into action in order to hold the elevator cage 12 exactly at the correct vertical position.

Figure 2:
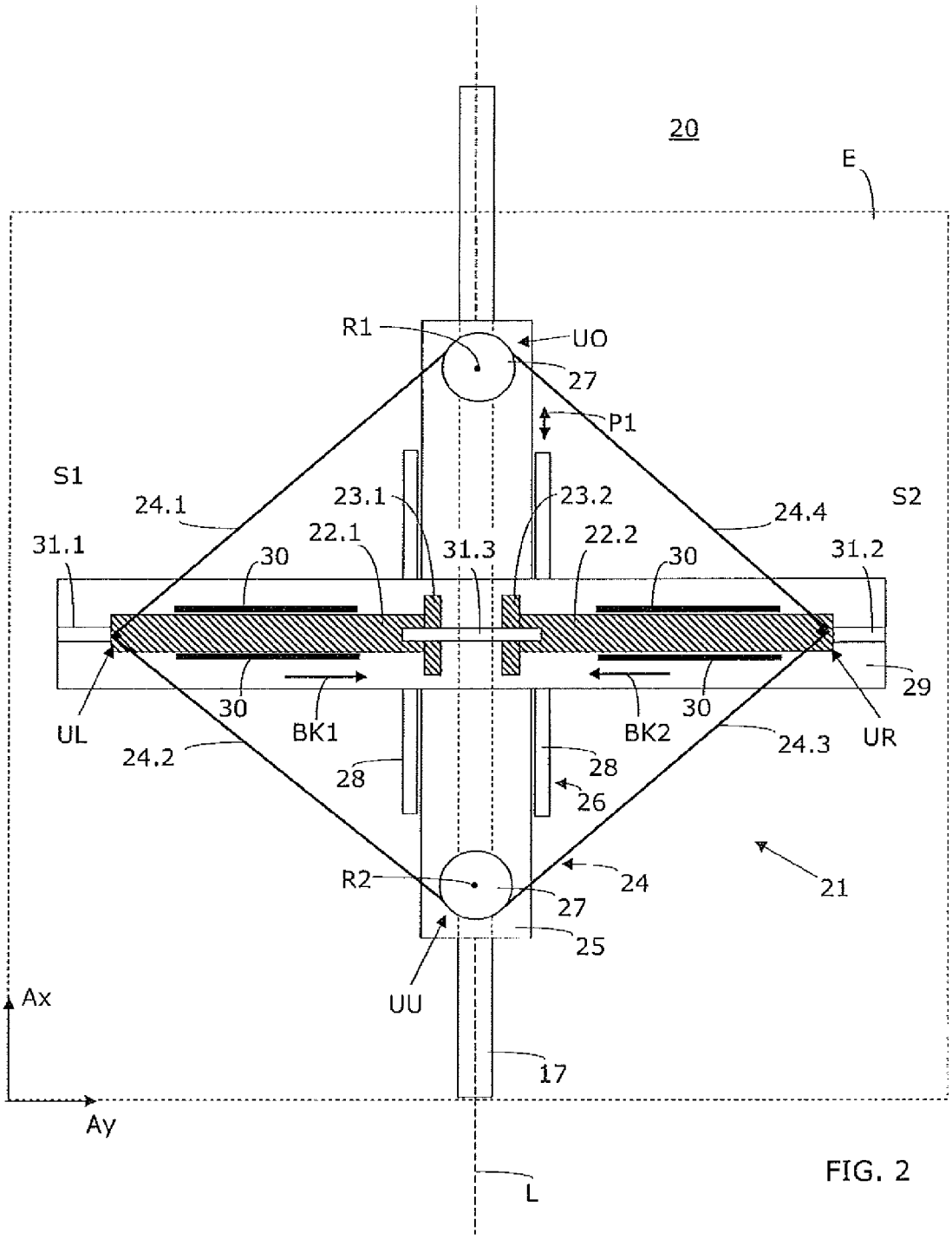
FIG. 2 shows details of a first holding brake.
Figure 3:
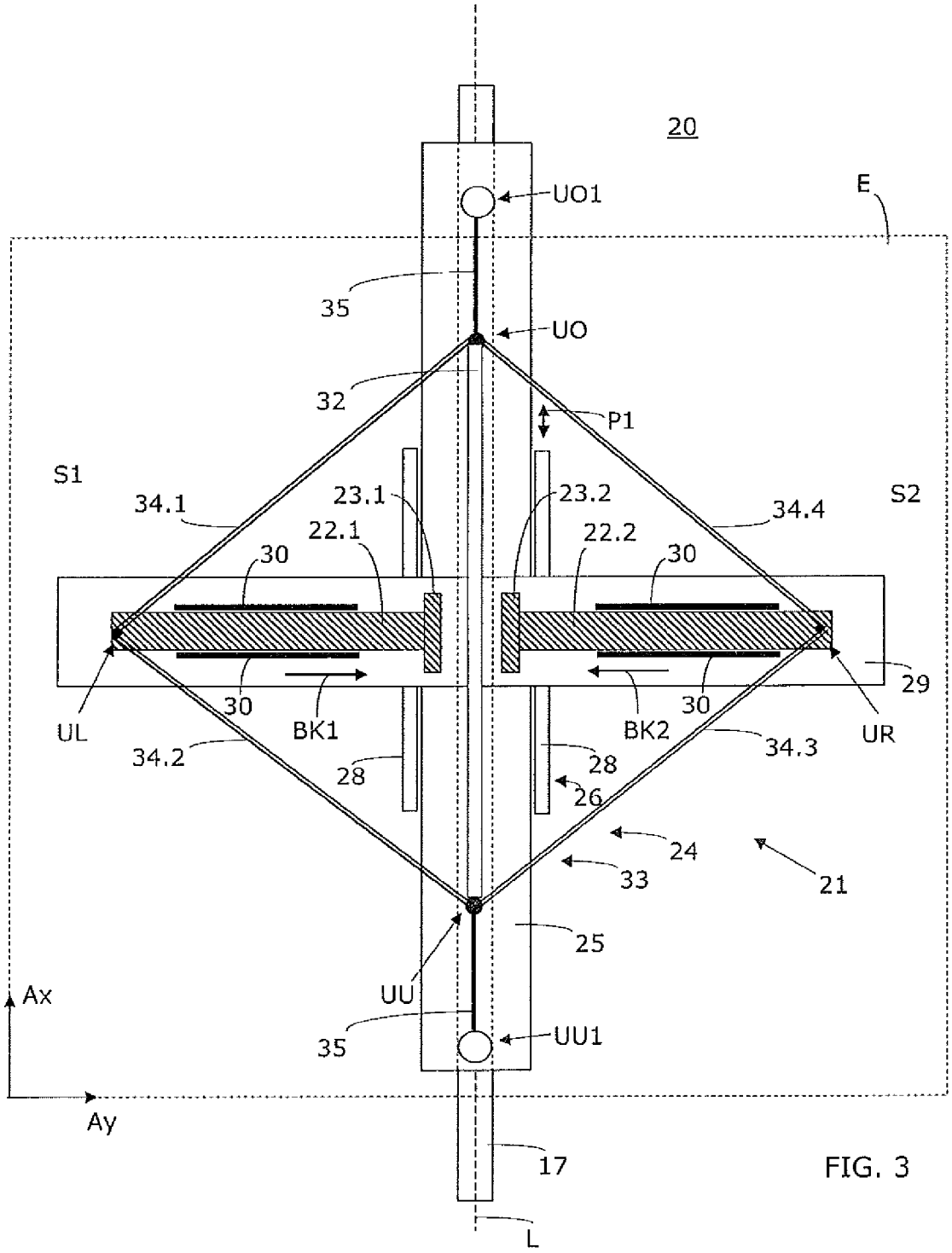
FIG. 3 shows details of a second holding brake.

The holding brake 20, which is described in more detail in two different forms of embodiment with reference to FIGS. 2 and 3, is designed for use in an elevator installation 10. The holding brake 20 serves for application of a mechanical braking action relative to a stationary guide rail 17 of the elevator installation 10. The elevator cage 12 is held in its vertical position in the elevator shaft 14 by the holding brake 20 after actuation thereof.

The holding brake 20 comprises a locking mechanism 21, possibly a double-acting locking mechanism 21. The locking mechanism 21 is so designed and constructed that it acts on the guide rail 17 from two mutually opposite sides S1, S2.

A view of the holding brake 20 is shown in each of FIGS. 2 and 3, in which the double-acting locking mechanism 21 acts from the left (side S1) and from the right (side S2) on the guide rail 17. In the case of action on the guide rail 17 the locking mechanism 21 exerts, for example, an advancing force BK1 and an oppositely directed advancing force BK2 on the guide rail 17.

The locking mechanism 21 can comprise a first brake body 22.1 and a second brake body 22.2. These brake bodies 22.1, 22.2 are opposite one another. The first brake body 22.1 has a first brake shoe 23.1 on a side facing the second brake body 22.2. The second brake body 22.2 has a second brake shoe 23.2 on a side facing the first brake body 22.1. The first brake body 22.1 presses together with the first brake shoe 23.1 by the advancing force BK1 or by a force proportional to the advancing force BK1 from the side S1 against the guide rail 17. The second brake body 22.2 presses together with the second brake shoe 23.2 by the advancing force BK2 or by a force proportional to the advancing force BK2 from the side S2 against the guide rail 17.

The first brake body 22.1 and the second brake body 22.2 can be so movably mounted at a guide body 26 that they are movable towards and away from one another.

The locking mechanism 21 can be designed that the two advancing forces BK1 and BK2 are of equal magnitude. It is thereby achieved that the double-acting locking mechanism 21 is constructed/arranged to be symmetrical mechanically and/or in terms of force with respect to the longitudinal axis L of the guide rail 17.

The locking mechanism 21 can be coupled to a traction device 24 acting from the sides S1, S2, as is shown in FIGS. 2 and 3.

This traction device 24 is so constructed/arranged symmetrically with respect to the first brake body 22.1 and the second brake body 22.2 that two traction elements 24.1, 24.2 of the traction device 24 are connected with the first brake body 22.1 and two further traction elements 24.3, 24.4 of the traction device 24 are connected with the second brake body 22.2

The traction device 24 can comprise a traction cable (for example a steel cable) which is arranged so that four cable sections 24.1, 24.2, 24.3, 24.4 of the traction cable result, as shown in FIG. 2. The four cable sections 24.1, 24.2, 24.3, 24.4 can form a form of lozenge or parallelogram with lateral corner points or lateral points UL, UR at the two distal ends of the brake bodies 22.1, 22.2 and with an upper distal point or upper deflection point UO at a fastening element 25 of the holding brake 20 and with a lower distal point or lower deflecting point UU at the fastening element 25 of the holding brake 20.

The traction cable of the traction device 24 can be fixedly connected at the lateral deflecting points UL, UR with the respective brake body 22.1 or 22.2. Possibly provided at the upper deflecting point UO and at the lower deflecting point UU are (deflecting) rollers 27 (as shown in FIG. 2) or slide posts, so that the traction cable can run around or slide around these deflecting points UO and UU. The axes R1, R2 of these rollers 27 or slide posts are perpendicular to the plane E (which here coincides with the plane of the drawing).

The holding brake 20 can comprise a fastening element 25 and a guide body 26, as shown in FIGS. 2 and 3. The fastening element 25 is designed for fastening the holding brake 20 to the elevator cage 12 and the guide body 26 is mounted to be displaceable along the fastening element 25. The corresponding displacement movement is indicated in FIG. 2 and FIG. 3 by the double arrow P1.

The guide body 26 can have two mutually parallel extending rails or slide surfaces 28, which in the mounted state run parallel to the longitudinal axis L. In addition, the guide body 26 comprises a cross member 29 which is fixedly connected with the rails or slide surfaces 28.

The fastening element 25 and the cross member 29 can be arranged perpendicularly to one another and form a kind of cross.

The cross member 29 can carry (horizontal) guides 30 for horizontal guidance of the brake bodies 22.1, 22.2. The two brake bodies 22.1, 22.2 can be mounted to be so movable in, at or between the guides 30 that they can execute an advancing movement in the direction of the guide rail 17.

In some embodiments at least one active actuator is employed in order to be able to actively execute initial movements or advancing movements. These movements serve the purpose of bringing the locking mechanism 21 into a position in which this can build up the holding force with a minimum advance travel. In the case of the form of embodiment shown in FIG. 2, use can be made of a total of three actuators 31.1, 31.2, 31.3. The actuator 31.1 advances the brake body 20.1 in the direction of the guide rail 17 so that the first brake shoe 23.1 presses, when required, against the guide rail 17. The actuator 31.2 advances the brake body 22.2 in the direction of the guide rail 17 so that the second brake shoe 23.2 presses, also when required, against the guide rail 17. Use can be made of a middle (restoring) actuator 31.3 in order to be able to urge the brake shoes 23.1, 23.2 apart for release of the holding brake 20. The position of the brake shoes 23.1, 23.2 can be optimally preset and in the case of need also re-adjusted by co-operation of the actuators 31.1, 31.2, 31.3. The actuators 31.1, 31.2 trigger a first braking action. The actuator 31.3 releases the holding brake 20 again.

The presetting of a minimum braking force by one or more actuators can also be employed so that the holding brake 20 does not automatically open in the case of a corresponding transition through the zero position when a load change from an empty elevator cage 12 to a full elevator cage takes place.

In FIG. 3 only a central actuator 32 is employed, which extends parallel to the longitudinal axis L and is seated between the upper deflecting point UO and the lower deflecting point UU. This central actuator 32 combines the braking action and the release of the holding brake 20 in one. The actuator 32 thus replaces the actuators 31.1, 31.2, 31.3.

In at least some embodiments, the locking mechanism 21 is equipped with at least one actuator in order to be able to so advance the brake bodies 22.1, 22.2 in an initial movement that they exert a braking action in order to fix the elevator cage 12.

In at least some cases, the actuators comprise a spring and an active actuator element which expands or contracts by, for example, application of a voltage. An actuator in the sense of the present disclosure is a component or an element which converts a signal of a regulating means into mechanical work or movement. The signal can be an electrical, a hydraulic or a pneumatic signal.

The locking mechanism 21 can comprise a traction cable with several sections 24.1 to 24.4, as shown in FIG. 2. The rollers 27 serve as deflecting rollers around which the traction cable is guided. The traction cable is fastened at the points UL and UR so as to be able to build up a traction force which by virtue of the symmetrical disposition/path of the traction cable acts at the points UL and UR perpendicularly in the direction of the guide rail 17.

However, the locking mechanism 21 can also comprise, instead of the traction cable, a linkage 33 with several rods 34.1 to 34.4 loadable in tension and compression, as shown in FIG. 3. In order that this locking mechanism 21 according to FIG. 3 is equivalent in effect to the locking mechanism according to FIG. 2, a short length of a traction cable 35 is attached at each of the deflecting points UO and UU. These traction cables 35 are tensioned between the points UO1 and UO or between UU1 and UU.

The traction cable of FIG. 2 and the linkage 33 inclusive of the short traction cables 35 constitute a so-termed traction element acting from one side. The action of this unilaterally acting traction element is as follows:

When the elevator cage 12 is located at a story (for example story B in FIG. 1), the holding brake 20 comes into play as follows:

The brake bodies 22.1, 22.2 are advanced by the actuators 31.1, 31.2 and the brake shoes 23.1, 23.2 come into interaction with the guide rail 17. A first braking action thereby results. If the elevator cage 12 should now drop a small amount, for example because a large load is contained in the elevator cage 12, the fastening element 25, which is fixed to the elevator cage 12, displaces downwardly in company with the elevator cage 12 a few millimeters. At the same time the traction elements 24.2 and 24.3 pull obliquely downwardly at the points UL and UR. By virtue of this symmetrically acting traction force the brake bodies 22.1, 22.2 are further advanced and the brake shoes 23.1, 23.2 press even more firmly from both sides symmetrically against the guide rail 17.

In at least some embodiments, by virtue of their unilateral character, the traction elements 24.1 and 24.4 do not exert any pressing force on the brake shoes 23.1, 23.2, which would impair the braking action.

The converse takes place if the elevator cage 12 should move upwardly a small amount, for example if a large load is removed from the elevator cage 12. Here the traction elements 24.1, 24.4 come into play.

In a form of embodiment according to FIG. 3 in which the unilaterally acting traction element comprises a linkage 33 with traction cables 35 the manner of effect is in principle the same. In the case of a downward movement of the elevator cage 12 the lower cable length 35 pulls at the point UU and the rods 34.2, 34.3 symmetrically pull at the points UL, UR. Through this symmetrically acting traction force the brake bodies 22.1, 22.2 are further advanced and the brake shoes 23.1, 23.2 press even more firmly from both sides symmetrically against the guide rail 17.

The converse takes place if the elevator cage 12 should move a small amount upwardly. Here the upper cable length 35 pulls at the point UO and the rods 34.1, 34.4 pull symmetrically at the points UL, UR.

As a result, in at least some embodiments, every smallest positional deviation of the elevator cage 12 is immediately converted into an amplified braking action of the holding brake 20. In the embodiment according to FIG. 2, the (deflecting) rollers 27 guarantee that the respective traction elements 24.1 to 24.4 pull with the same forces symmetrically at the points UL, UR. In the case of a form of embodiment according to FIG. 3, the short traction cables 35 ensure a uniform traction effect as long as the lengths of the rods 34.1 to 34.4 are identical and the positions of the points UO and UU are central.

In order to release the braking action of the holding brake 20, use can be made of the actuator 31.3 or 32 which urges the brake shoes 23.1, 23.2 apart. The release of the holding brake 20 typically takes place only when the drive 11 has applied sufficient torque (termed pre-torque) for driving the elevator cage 12.

Some embodiments eliminate a load measurement in the elevator cage 12, since the actuator can open the holding brake 20 only when there is sufficient pre-torque. For this purpose the pre-torque can be increased until the actuator is in a position of releasing the holding brake 20. In the case of incorrect pre-torque, release of the holding brake 20 is generally hardly possible, which can lead to improved safety. In the embodiment of FIG. 3, the actuator 32 is shortened and thereby urges, due to the stiffness of the rods of the linkage 33, the brake bodies 22.1, 22.2 outwardly. Release of the holding brake 20 takes place here in this manner.

The holding brake 20 is thus a braking device which symmetrically engages a stationary guide rail 17 on both sides.

Such a holding brake 20 can be mounted on the elevator cage 12 and/or the counterweight 19.

The holding brake 20 can prevent drifting of the elevator cage 12 away from the story level. Re-regulations by the elevator drive 11 can be eliminated.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation holding brake coupled to an elevator cage or a counterweight, comprising:

first and second brake shoes;

a first actuator coupled to the first brake shoe;

a second actuator coupled to the second brake shoe, the first and second actuators being configured to cause the first and second brake shoes to press against and produce a braking force at a guide rail of the elevator installation for holding the elevator cage or the counterweight that is at a fixed position relative to the guide rail;

a locking mechanism;

a traction device coupled to the locking mechanism; and a cross member, the first and second brake shoes being arranged at and linearly guided along the cross member, the cross member being movable relative to the traction device, the traction device being configured to cause the first and second brake shoes to amplify the braking force produced by pressing against the guide rail through movement of the traction device relative to the cross member.

2. The elevator installation holding brake of claim 1, wherein the locking mechanism is a double-acting locking mechanism comprising a first brake body and a second brake body, the first and second brake bodies being arranged opposite each other, the first brake body being coupled to the first brake shoe and the second brake body being coupled to the second brake shoe, the first and second brake shoes being arranged opposite each other.

3. The elevator installation holding brake of claim 1, wherein the traction device acts at opposite sides of the locking mechanism.

4. The elevator installation holding brake of claim 3, wherein the traction device is arranged symmetrically with respect to the first brake body and the second brake body, wherein first and second traction elements of the traction device are connected with the first brake body, and wherein third and fourth traction elements of the traction device are connected with the second brake body.

5. The elevator installation holding brake of claim 1, further comprising a fastening element and a guide body, the fastening element being configured to fasten the holding brake to the elevator cage, and the guide body being mounted to be displaceable along the fastening element.

6. The elevator installation holding brake of claim 5, wherein the first and second brake bodies are movable relative to each other on the guide body.

7. The elevator installation holding brake of claim 1, further comprising a third actuator, the third actuator being configured to release the holding brake.

8. An elevator installation comprising:

an elevator cage disposed in an elevator shaft;

a guide rail disposed in the shaft; and a holding brake coupled to the elevator cage, the holding brake comprising, first and second brake shoes, a first actuator coupled to the first brake shoe, a second actuator coupled to the second brake shoe, the first and second actuators being configured to cause the first and second brake shoes to press against and produce a braking force at the guide rail to hold the elevator cage that is at a fixed position relative to the guide rail, a locking mechanism, a traction device coupled to the locking mechanism, and a cross member, the first and second brake shoes being arranged at and linearly guided along the cross member, the cross member being movable relative to the traction device, the traction device being configured to cause the first and second brake shoes to amplify the braking force produced by pressing against the guide-rail.

9. An elevator operation method comprising:

exerting a first braking force by engaging and pressing first and second brake shoes of a holding brake against a guide rail, the engaging being performed using respective first and second actuators, the holding brake being coupled to an elevator cage or to a counterweight and the exerting being performed when the elevator cage or the counterweight is at a fixed position relative to the guide rail; and exerting a second braking force with the first and second brake shoes using a locking mechanism of the holding brake as a result of a movement of the elevator cage or as a result of a movement of the counterweight, the locking mechanism causing the first and second brake shoes to amplify the first braking force exerted by pressing against the guide rail to exert the second braking force.

10. The elevator operation method of claim 9, wherein the movement of the elevator cage or the movement of the counterweight comprises an impermissible movement.

11. The elevator operation method of claim 9, further comprising releasing the holding brake, wherein releasing the holding brake comprises:

building up a holding force by a drive while a locking mechanism of the holding brake diminishes the holding force;

releasing the first and second brake shoes when the holding force has reached a selected level; and holding the elevator cage or the counterweight in a rest position using the drive.

* * * * *